United States Patent [19]

Karlsson

[11] 4,016,724

[45] Apr. 12, 1977

[54] STEAM ENGINE

[76] Inventor: Hans Ingemar Reimertz Karlsson, Vintervagen 17, Stockholm-Jarfalla, Sweden, S-175 40

[22] Filed: Jan. 30, 1976

[21] Appl. No.: 653,829

[30] Foreign Application Priority Data

Jan. 31, 1975 Sweden ..... 7501076

[52] U.S. Cl. ..... 60/672; 60/673; 60/674; 60/509; 60/511; 60/649; 60/715

[51] Int. Cl.[2] ..... F01K 25/06

[58] Field of Search ..... 60/511, 672, 673, 674, 60/649, 715

[56] References Cited

UNITED STATES PATENTS 3,192,705 7/1965 Miller ..... 60/511

*Primary Examiner*—Allen M. Ostrager

*Attorney, Agent, or Firm*—Browdy and Neimark

[57] ABSTRACT

A steam or vapor engine comprising a vapor generating apparatus, at least one cylinder with a piston working in the cylinder, and pipes and valves for supplying vapor from the vapor generating apparatus to a closed chamber, formed in the cylinder, and for discharging vapor from the cylinder chamber after a working stroke, and an apparatus for supplying an additive, which rapidly expands at the temperature of the vapor, to the cylinder chamber essentially simultaneously with the vapor.

15 Claims, 3 Drawing Figures

STEAM ENGINE

Figure 1:
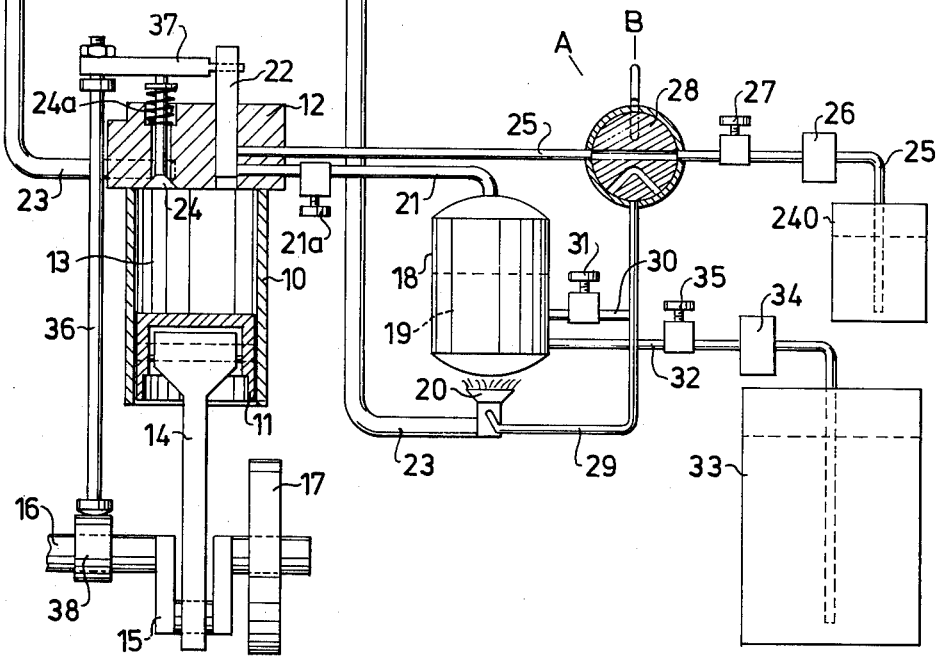

The present invention relates to a steam engine and particularly to a steam engine with a device for increasing the steam engine power. A steam engine comprises a steam generating apparatus, at least one cylinder having a member working in the cylinder, pipes and valves for supplying steam from the steam generating apparatus to the closed chamber formed in the cylinder, and pipes and valves for discharging steam from the cylinder chamber after a working stroke.

Engines driven by steam are previously known. Such engines have, however, the disadvantage that they become large and heavy when they are designed for large power output. In order to improve the power and performance of steam engines, attempts have been made to mix the steam with other substances, but this has only resulted in limited power increases and has not removed the large drawbacks due to the comparatively high weight and the large space requirement of steam driven engines.

The main object of the invention is to enable an increase of the power output of steam engines to provide steam driven engines having high power output in spite of comparatively low weight and small dimensions.

This object is achieved by giving the steam engine according to the invention the characterizing features set forth in claim 1.

Since the additive supplied to the cylinder chamber consists of a substance which expands rapidly at the temperature of the steam, and this expansion takes place in the cylinder chamber, substantially increased power is obtained during each working stroke of the engine. This power increase has the advantage that an engine with a given power output can be made substantially smaller and lighter when the invention is utilized than what is possible with the utilization of previously known design principles.

According to the invention combustible additive is used, preferably a liquid which when vaporized gives a combustible gas or gas mixture. By passing the steam and gas mixture, exhausted from the cylinder chamber, to the heat generating device and burning the gas mixture there, an extremely effective utilization of the additive is obtained both for driving the working member in the cylinder and for supplying heat to the steam generating apparatus. Furthermore, through the achieved combustion of the steam and gas mixture flowing from the cylinder, a minimum of exhaust gases from the engine is obtained, which means that the engine will be very harmless to the environment. This is an important advantage, especially when the engine is used in motor cars. A still further advantage of the invention is that many liquids or gases which are not petroleum products can be used as additives. Since the additive also can be used for preheating the steam generating apparatus, necessary for starting the engine, according to the invention an engine can be provided, which can be driven entirely on a fuel which is more easily available than those at present mainly used for internal combustion engines in motor cars and similar vehicles.

An embodiment of the invention will now be more closely described with reference to the attached drawings.

FIG. 1 schematically shows a portion of a piston engine with the necessary means for applying the invention.

Figure 3:
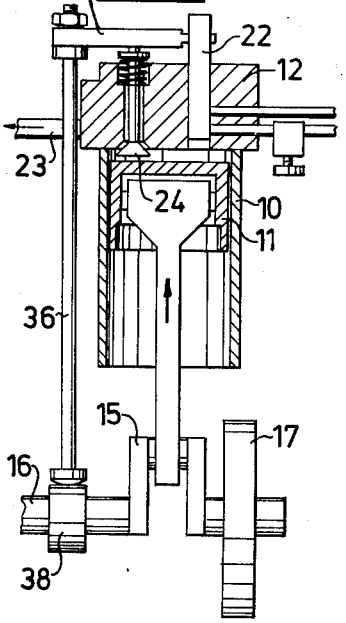
Figure 2:
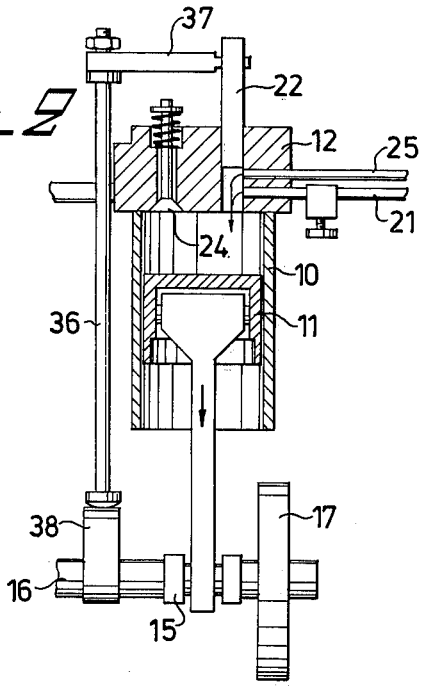

FIGS. 2 and 3 schematically show the engine cylinder according to FIG. 1 with the piston in other positions.

The engine shown in FIG. 1 comprises a right, circular cylinder 10, in which a reciprocating piston 11 is arranged. The cylinder is at its upper end covered by a cylinder head 12, so that a closed cylinder chamber 13 is formed in the cylinder between the movable piston and the cylinder head. The movable piston 11 is in the usual way provided with a connecting rod 14, connected to a crank 15 on a crank shaft 16, the latter also being provided with a flywheel 17 for providing a smooth running engine. The piston is intended to be driven by steam, and for generating this steam there is arranged a container 18, which contains a certain amount of water 19. Under the container there is a burner 20, arranged for heating the water in the container 18 to a temperature at which the water is vaporized. Steam is supplied through a pipe 21 to the cylinder chamber 13 between the piston and the cylinder head. The pipe is provided with a regulating valve 21*a* for controlling the steam pressure. The supply of steam to the cylinder is controlled by means of an inlet valve 22 positioned in the cylinder head 12. For discharging the steam from the cylinder chamber after a working stroke of the piston there is an exhaust pipe 23, and the discharge through this pipe is controlled by means of an exhaust valve 24 in the cylinder head 12. The valve 24 is kept closed by means of a spring 24*a*.

The engine is provided with a fuel tank 240 which is connected to the cylinder 10 via a pipe 25 for supplying fuel to the cylinder chamber 13. A pump 26, a control valve 27 and a reversing valve 28 are inserted in the pipe 25 between the fuel tank and the cylinder. In the embodiment shown, the fuel consists of a liquid which rapidly vaporizes at the temperature of the steam when supplied to the cylinder, thereby increasing the working pressure of the steam, and which when gaseous is combustible and easy ignitable. The supply of the fuel to the cylinder is controlled by the same inlet valve 22 controlling the supply of steam to the cylinder.

The reversing valve 28 is also connected to a pipe 29 through which fuel can be supplied from the tank 240 to the burner 20 under the container 18 for heating the water in the container. From this pipe 29 there is also a branch pipe 30 to the interior of the container 18, so that fuel can be introduced into the container for mixing with the water already there. A shut-off valve 31 is positioned in the branch pipe.

The container 18 is also connected to a water supply tank 33 by means of a connecting pipe 32 for refilling water into the container, when required. In this pipe there is a pump 34 and a regulating valve 35 for transferring water from the supply tank to the container.

The valves 22 and 24, positioned in the cylinder head 12 for controlling the intake of steam and fuel gas and the exhaust of the steam-gas mixture, are controlled by means of a push rod 36 and a rocker arm 37 connected to the upper end thereof, the arm being adjustable in height and arranged to control the inlet and exhaust valves, as will be more closely explained below. The push rod 36 is arranged to engage with its bottom end against a cam 38 firmly attached to the crank shaft 16.

The engine works in the following way: When the engine is to be started, the reversing valve 28 is set to the start position A, in which the pipe 25 from the fuel tank is connected with the pipe 29 to the burner under the container, whereafter the fuel fed to the burner is ignited in a suitable manner. When sufficient steam pressure has been obtained in the container, the reversing valve 28 is reset to the run position B, so that fuel is supplied through the pipe 25 to the cylinder as shown in FIG. 1. The crankshaft is now turned manually or by means of a start motor, so that the piston comes into the position shown in FIG. 2. In this position the cam 38 arranged on the crankshaft has lifted the push rod 36 to its upper position in which the push rod lifts up the inlet valve slide 22 to a position in which the slide uncovers the openings of the supply pipes 21, 25 for steam from the container and fuel from the fuel tank, respectively. Steam thereby flows into the cylinder chamber 13 between the piston and the cylinder head, and expands so that the piston is pushed downward. Essentially simultaneously with the steam, fuel flows in as well, and is vaporized because of the high temperature prevailing in the cylinder chamber due to the temperature of the inflowing steam. The expanding steam in combination with the vaporized fuel, which expands heavily on vaporization provides a forceful downward thrust of the piston in the cylinder for carrying out the working stroke of the piston. During this working stroke the piston is thrust down to its bottom position, as shown in FIG. 1. Due to the kinetic energy stored in the flywheel and the crank during the working stroke, the piston continues upwards from its lowest position, towards the upper position. During this upward movement of the piston, the push rod 36 is in engagement with the cam 38, which because of its configuration allows the push rod to be lowered to its lower position in which the rocker arm 37 engages with the valve shank of the exhaust valve 24 so that this valve shank is forced downwards to uncover the opening of the exhaust pipe 23, as shown in FIG. 3, the steam and gas mixture in the cylinder chamber then being forced out through the pipe 23.

The steam and gas mixture exhausted from the cylinder is supplied through the pipe 23 to the burner 20 arranged under the container 18, and is ignited and burned on it. The amount of gas inducted into the cylinder should be so large that the combustion of the gas exhausted from the cylinder is sufficient for supplying the necessary quantity of heat for maintaining steam pressure in the container 18. This is achieved by a suitable design of the mouth or nozzle of the pipe 25 in relation to the available pressure in the fuel supply line and the opening time of the inlet valve 22.

When starting up, it is suitable to open the valve 31 in the branch pipe 30, so that fuel in a liquid form can be supplied to the container 18 and mixed with the water in it. Since the fuel vaporizes at a lower temperature than the water, the time required for obtaining sufficient vapor pressure is reduced, so that the engine can be started more quickly.

As fuel for the engine described above is suitably used a monovalent primary alcohol, e.g. methyl alcohol. This liquid has the advantage of vaporizing quickly at the temperature of the steam, and is easily miscible with water, at the same time as it is cheap and, in contrast to petrol and diesel oil, is not based on any petroleum product.

Even if only one embodiment of the engine according to the invention has been described above, it is obvious that a plurality of modifications and other embodiments are possible within the scope of the inventive idea. It is, for example, not necessary to utilize the steam-gas-mixture exhausted from the cylinder for supplying heat to the steam generating apparatus. In such a case there is great freedom to choose the amount of fuel supplied for each working stroke, since no consideration needs to be taken to keeping the burner running on the gas received from the cylinder. It is further possible to supply fuel to the burner under the container both from the cylinder and from the fuel tank, but the reversing valve must then have a somewhat different design, so that a definite but reduced amount of fuel is continuously supplied to the burner during normal running of the engine. It is still further possible to provide the engine with a condensor for condensing the steam exhausted from the cylinder, so that the water consumption is rediced. The system can hereby be made more or less closed. If the system is made completely closed, no special water tank is required, and the amount of water in the container is sufficient for running the engine continuously. If a closed system is used, media other than water can be used in the vapor generating apparatus, which can be advantageous in certain applications. The fuel tank shown does not need to be made for containing a fuel in the form of a liquid, but can be replaced by a gas container, provided that the gas used expands sufficiently heavily on induction into the cylinder for giving substantial contribution to the force required for driving the working member in the cylinder.

The closed chamber in which expansion of the vapor and additive takes place does not need to have a cylindrical shape but can have the shape used for example in the Wankel-engine, in which the piston is replaced by a rotor.

Many other fuels can be used instead of the above mentioned monovalent primary alcohol, e.g. other monovalent primary alcohols, ketones, aldehydes, ethers, methan, butane and petroleum products such as petrol (gasoline). Many of the above-mentioned fuels can with advantage be mixed with the water in the vapor generating apparatus and the storage containers, if any, for preventing the water from freezing.

If a closed system is used for the vaporizable medium in the vapor generating apparatus, a cooled cylinder provided with a piston is suitably used as condensor, the sub-pressure achieved during condensation being utilized for driving the piston in the cooled cylinder, and the movement of the piston can then be utilized in a manner known per se for driving pumps, for example.

What is claimed is:

1. A steam or vapor engine, comprising a vapor generating apparatus producing vapor of at least a given temperature; at least one cylinder with a member working in the cylinder; pipes and valves for supplying said vapor from the vapor generating apparatus to a closed chamber formed in the cylinder; pipes and valves for exahausting vapor from the cylinder chamber after a working stroke; and an apparatus for supplying to said chamber substantially simultaneously with the vapor an additive which has a lower temperature than said given temperature and which rapidly expands at the temperature of the vapor.

2. An engine as claimed in claim 1, wherein the additive is combustible.

3. An engine as claimed in claim 1, wherein the additive is a vaporizable liquid.

4. An engine as claimed in claim 1, wherein said additive is combustible and a pipe going from the cylinder chamber extends to the vapor generating apparatus and is there connected to a burner for burning the additive to supply heat to the vapor generating apparatus.

5. An engine as claimed in claim 4, wherein a pipe is provided for supplying the combustible additive directly to said burner of the vapor generating apparatus to supply heat to the vapor generating apparatus.

6. An engine as claimed in claim 5, wherein a pipe is provided for supplying the combustible substance in liquid form to the vapor generating apparatus for mixing with the medium to be vaporized in the vapor generating apparatus to provide quicker starting of the engine.

7. An engine as claimed in claim 1, comprising a closed vapor system, wherein a pipe leading from the cylinder chamber is connected to a cooled cylinder provided with a piston, in which vapor is condensed, the arising low pressure being utilized for driving the piston in the cooled cylinder.

8. An engine as claimed in claim 1, wherein the medium to be vaporized in the vapor generating apparatus is water.

9. An engine as claimed in claim 8, wherein the combustible liquid additive is easily miscible with water.

10. An engine as claimed in claim 9, wherein the additive comprises a monovalent primary alcohol.

11. An engine as claimed in claim 1, wherein a valve means is provided to control the supply of both steam and additive to the cylinder chamber.

12. A steam or vapor engine, comprising a vapor generating apparatus; at least one cylinder with a member working in the cylinder; pipes and valves for supplying vapor from the vapor generating apparatus to a closed chamber formed in the cylinder; pipes and valves for exhausting vapor from the cylinder chamber after a working stroke; and an apparatus for supplying a combustible additive, which rapidly expands at the temperature of the vapor, to the cylinder chamber simultaneously with the vapor; and wherein a pipe going from the cylinder chamber extends to the vapor generating apparatus and is there connected to a burner for burning the additive to supply heat to the vapor generating apparatus.

13. An engine as claimed in claim 12, wherein a pipe is provided for supplying the combustible additive directly to said burner of the vapor generating apparatus to supply heat to the vapor generating apparatus.

14. An engine as claimed in claim 13, wherein a pipe is provided for supplying the combustible substance in liquid form to the vapor generating apparatus for mixing with the medium to be vaporized in the vapor generating apparatus to provide quicker starting of the engine.

15. A steam or vapor engine, comprising a vapor generating apparatus; at least one cylinder with a member working in the cylinder; pipes and valves for supplying vapor from the vapor generating apparatus to a closed chamber formed in the cylinder; pipes and valves for exhausting vapor from the cylinder chamber after a working stroke; and an apparatus for supplying an additive, which rapidly expands at the temperature of the vapor, to the cylinder chamber essentially simultaneously with the vapor, and a pipe leading from the cylinder chamber connected to a cooled cylinder provided with a piston, in which the vapor is condensed, the arising low pressure being utilized for driving the piston in the cooled cylinder, said pipe, chamber and cooled cylinder being parts of a closed vapor system.

* * * * *